United States Patent [19]

Hibino et al.

[11] Patent Number: 4,721,082

[45] Date of Patent: Jan. 26, 1988

[54] METHOD OF CONTROLLING AN AIR/FUEL RATIO OF A VEHICLE MOUNTED INTERNAL COMBUSTION ENGINE

[75] Inventors: Yoshitaka Hibino; Takeshi Fukuzawa; Atsushi Totsune, all of Wako, Japan

[73] Assignee: Honda Giken Kogyo Kabushiki Kaisha, Tokyo, Japan

[21] Appl. No.: 6,042

[22] Filed: Jan. 22, 1987

[30] Foreign Application Priority Data

Jan. 22, 1986 [JP] Japan ..... 61-012403

[51] Int. Cl.[4] ..... F02M 3/00

[52] U.S. Cl. ..... 123/339; 123/585

[58] Field of Search ..... 123/339, 438, 478, 585

[56] References Cited

U.S. PATENT DOCUMENTS 4,376,427 3/1983 Mizuno ..... 123/339

4,617,890 10/1986 Kobayashi et al. ..... 123/339

*Primary Examiner*—Stephen F. Husar

*Attorney, Agent, or Firm*—Pollock, VandeSande & Priddy

[57] ABSTRACT

A method determines a control parameter of an air/fuel ratio of an internal combustion engine having an idle rotational speed control device by which the throttle valve is opened when an electric unit such as the head light or the air conditioner is turned on during the idling of the engine. The air/fuel ratio is controlled to be leaner than a target air fuel ratio when the engine is idling, and controlled to a further leaner side when the electric unit is operating during the idling of the engine.

1 Claim, 8 Drawing Figures

METHOD OF CONTROLLING AN AIR/FUEL RATIO OF A VEHICLE MOUNTED INTERNAL COMBUSTION ENGINE

BACKGROUND OF THE INVENTION

1. Field of the Invention

The present invention relates to a method of controlling an air/fuel ratio of an internal combustion engine mounted on a vehicle.

2. Description Of Background Information

Various air/fuel ratio control systems for internal combustion engines are known from, for example, Japanese Patent Publication No. 55-3533, which systems regulate the air/fuel ratio of mixture to be supplied to the engine toward a target air/fuel ratio value by a feedback control operation in which a control parameter for the air/fuel ratio control is set in response to the output signal of an oxygen concentration sensor disposed at the exhaust system of the engines thereby to regulate the volume of air or fuel the mixture to be supplied to the engines. The air/fuel ratio control parameter may be, for example, a valve-open period in an intake side secondary air supply system, or a fuel injection period in a fuel injection system.

Such air/fuel ratio control systems generally perform a control operation in which the feedback control of the air/fuel ratio according to the output signal of the oxygen concentration sensor is stopped and the air/fuel ratio is controlled to be leaner than the target air/fuel ratio during the engine is idling, so as to improve the fuel economy. However, as illustrated in FIG. 1, the fluctuation of the engine speed under the idling condition becomes large as the air/fuel ratio becomes lean. (In FIG. 1, ΔNe represents the width of the flucturation of the engine speed.) Thus, leaning of the air/fuel ratio not merely improves the fuel economy but also causes to deteriorate the driveability and to increase the vibration of the vehicle body.

On the other hand, in the case of internal combustion engines mounted on a vehicle, there is provided an idle rotational speed control device by which the throttle valve is forcibly opened so that the power current is stably supplied during an idling condition in which an electric unit having a relatively large electric load such as a head light and an air conditioner is in operation. When the throttle valve is opened by the idle rotational speed control device, the rotational speed of the engine is raised to increase the electric power generated by the generator. On the other hand, when the throttle valve is opened by the idle rotational speed control device, the weight of the intake air "Gair" increases as well. As shown in FIG. 2, the width ΔNe of the fluctuation of the rotational speed of the engine decreases as the weight of the intake air Gair increases. Thus, the driveability of the vehicle is improved and the vibration of the vehicle body is decreased as well. However, the opening of the throttle valve also results in an increase of the fuel consumption. Therefore, although the electric power supply to the unit of large electric load is assured and the driveability of the vehicle is improved, it was undesirable that the operation of the idle rotational speed control device causes an increase of the fuel consumption.

OBJECT AND SUMMARY OF THE INVENTION

Accordingly, an object of the subject invention is to provide an improved method of controlling the air/fuel ratio of an internal combustion engine equipped with an idle rotational speed control device, by which an increase of the fuel consumption is sufficiently reduced during an idling operation in which the unit of large electric load is in operation, while improving the driveability of the vehicle.

According to the present invention, the air/fuel ratio of the mixture to be supplied to the engine is controlled to the lean side with respect to a target air/fuel ratio under the steady state of the engine operation when the engine is idling, and the air/fuel ratio of the mixture is further shifted to the lean side when an operation of a unit of large electric load is detected during the idling of the engine.

DETAILED DESCRIPTION OF THE PREFERRED EMBODIMENT

Referring to the accompanying drawings, an embodiment of the control method of the present invention will be explained hereinafter.

Figure 4:
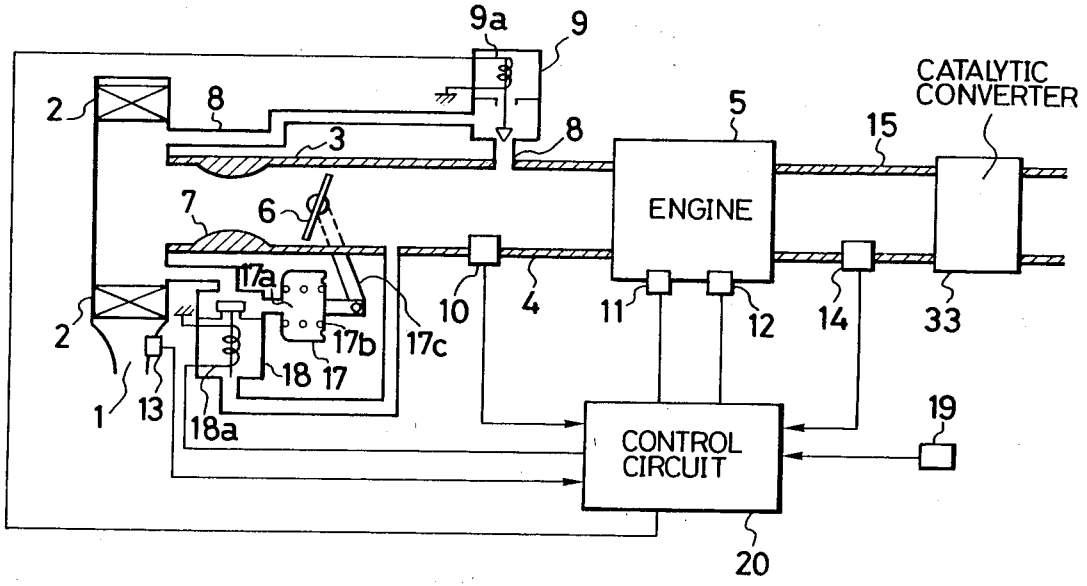
FIG. 4 is a schematic diagram showing a general construction of the air/fuel ratio control system in which the control method according to the invention is applied.

In FIG. 4 illustrates a general construction of an air intake side secondary air supply system of an internal combustion engine in which the control method for controlling the air/fuel ratio according to the present invention is applied. As shown, an intake air taken at an air inlet port 1 is supplied to an internal combustion engine 5 through an air cleaner 2, a carburetor 3, and an intake manifold 4. The carburetor 3 is provided with a throttle valve 6 and a venturi 7 on the upstream side of the throttle valve 6.

An inside of the air cleaner 2, near an air outlet port, communicates with the intake manifold 4 via an air intake side secondary air supply passage 8. The air intake side secondary air supply passage 8 is provided with a linear type solenoid valve 9. The opening degree of the solenoid valve 9 is varied according to the magnitude of a drive current supplied to a solenoid 9*a* thereof.

The throttle valve 6 is driven by means of an idle rotational speed control device in an opening direction during an idling operation in which a unit of the vehicle having relatively large electric load, such as the head light and the air conditioner (both not shown), are in operation. The idle rotational speed control device comprises a throttle opener 17 having a pressure chamber 17*a* and a three-way solenoid valve 18 having a solenoid 18*a*. When the solenoid 18*a* is deenergized, an atmospheric pressure is supplied to the pressure chamber 17*a* of the throttle opener 17 through the three-way solenoid valve 18. Conversely, when the solenoid 18*a* is energized, a vacuum in the intake manifold 4 is supplied to the pressure chamber 17*a* of the throttle opener 17 through the solenoid valve 18. When the vacuum is supplied to the pressure chamber 17*a*, a diaphragm 17*b* of the throttle opener 17 is drawn into the pressure chamber 17*a*, which in turn moves a lever 17*c* interlocked with the diaphragm 17*b* to open the throttle valve 6.

On the other hand, the system also includes an absolute pressure sensor 10 which is provided in the intake manifold 4 for producing an output signal whose level corresponds to an absolute pressure within the intake manifold 4, a crank angle sensor 11 which produces pulse signals in response to the revolution of an engine crankshaft (not shown), an engine cooling water temperature sensor 12 which produces an output signal whose level corresponds to the temperature of engine cooling water, an intake air temperature sensor 13 for sensing the temperature of the intake air, and an oxygen concentration sensor 14 which is provided in an exhaust manifold 15 of the engine for generating an output signal corresponding to an oxygen concentration in the exhaust gas. Further, a catalytic converter 33 for accelerating the reduction of the unburned components in the exhaust gas is provided in the exhaust manifold 15 at a location on the downstream side of the position of the oxygen concentration sensor 14. The linear type solenoid valve 9, the absolute pressure sensor 10, the crank angle sensor 11, the engine cooling water temperature sensor 12, the intake air temperature sensor 13, the oxygen concentration sensor 14, and the three-way solenoid valve 18 are electrically connected to a control circuit 20. Further, an electric load detection switch 19 which is interlocked with a light switch for lighting up the head light of the vehicle and an air conditioner switch, which turns on upon detection of the lighting of the head light or the operation of the air conditioner, is also connected to the control circuit 20. The electric load detection switch 19 produces a low level output signal when it is switched off, and a high level output signal when it is switched on.

Figure 5:
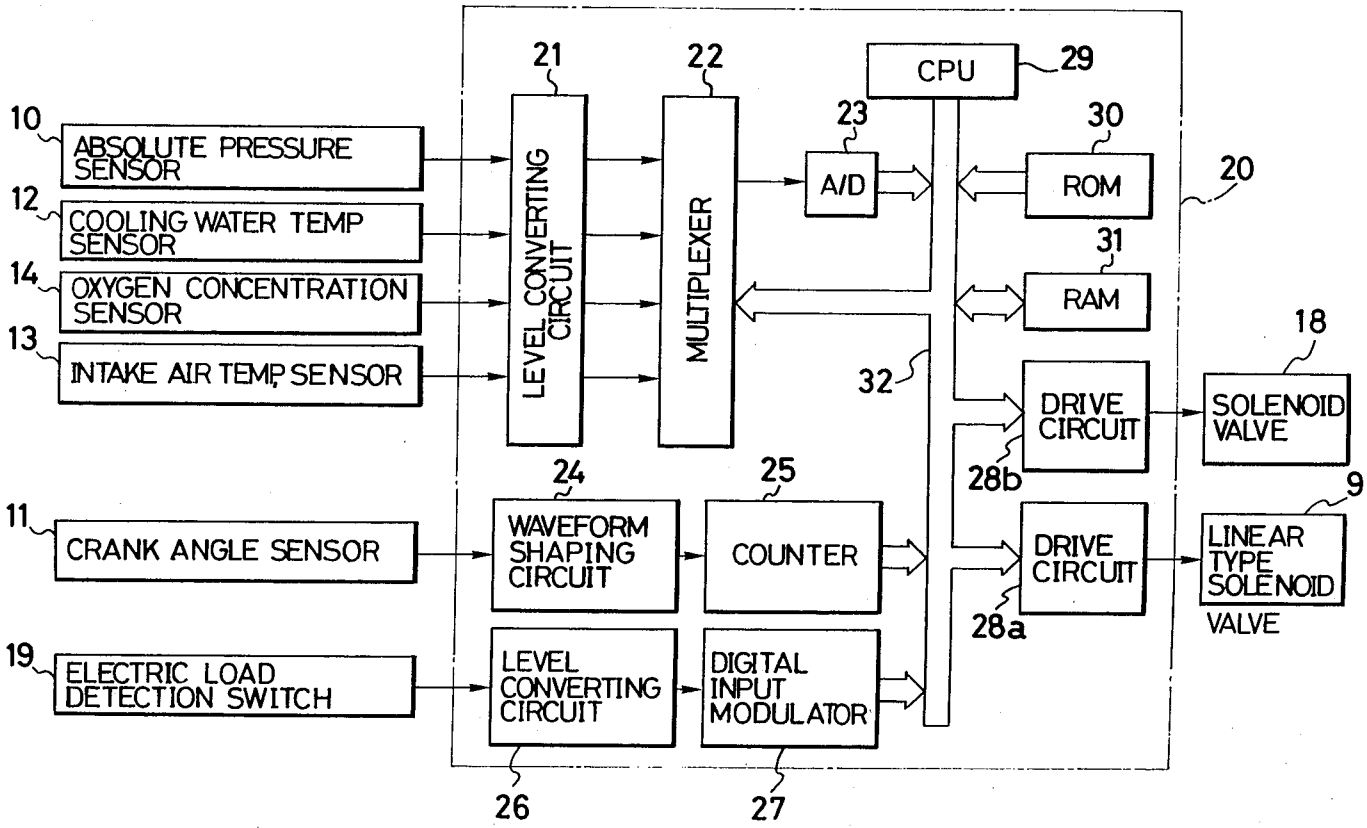
FIG. 5 is a block diagram showing the concrete construction of the control circuit 20 of the system of FIG. 4.

FIG. 5 shows the construction of the control circuit 20. As shown, the control circuit 20 includes a level converting circuit 21 which performs the level conversion of the output signals of the absolute pressure sensor 10, the engine cooling water temperature sensor 12, the intake air temperature sensor 13, and the oxygen concentration sensor 14. Output signals provided from the level converting circuit 21 are in turn supplied to a multiplexer 22 which selectively outputs one of the output signals from each sensor passed through the level converting circuit 21. The output signal provided by the multiplexer 22 is then supplied to an A/D converter 23 in which the input signal is converted into a digital signal. The control circuit 20 further includes a waveform shaping circuit 24 which performs a waveform shaping of the output signal of the crank angle sensor 11, to provide TDC signals in the form of pulse signals. The TDC signals from the waveform shaping circuit 24 are in turn supplied to a counter 25 which counts intervals of the TDC signals. The control circuit 20 further includes a level converter 26 for performing a level conversion of the output signal level of the electric load detection switch 19, a digital input modulator 27 which converts the switch output signal through the level converter 26 to a digital data, a drive circuit 28*a* for driving the solenoid valve 9, a drive circuit 28*b* for driving the solenoid valve 18, a CPU (central processing unit) 29 which performs digital operations according to various programs, a ROM 30 in which various operating programs and data are previously stored, and a RAM 31. The solenoid 9*a* of the solenoid valve 9 is connected in series with a drive transistor and a current detection resistor, both not shown, of the drive circuit 28*a*. A power voltage is applied across the terminals of the above mentioned series circuit. The multiplexer 22, the A/D converter 23, the counter 25, the digital input modulator 27, the drive circuits 28*a* and 28*b*, the CPU 29, the ROM 30, and the RAM 31 are mutually connected via an input/output bus 32.

In the thus constructed control circuit 20, information of the absolute pressure in the intake manifold 4, the engine cooling water temperature, the oxygen concentration in the exhaust gas, and the intake air temperature, is selectively supplied from the A/D converter 23 to the CPU 29 via the input/output bus 32. Also information indicative of the engine speed from the counter 25 and information of the on-off state of the electric load detection switch 19 from the digital input modulator 27 are supplied to the CPU 29 via the input/output bus 32. The CPU 29 is constructed to generate an internal interruption signal every one cycle of a predetermined period $T_1$ (5 m sec, for instance). In response to this internal interruption signal, the CPU 29 calculates an output value $T_{OUT}$ indicative of the magnitude of the current to the solenoid 9*a* of the solenoid valve 9, in the form of data. The calculated output value $T_{OUT}$ is in turn supplied to the drive circuit 28*a* as the air/fuel ratio control parameter. The drive circuit 28*a* performs a closed loop control of the magnitude of the current flowing through the solenoid 9*a* so that it is controlled to a value corresponding to the output value $T_{OUT}$.

Referring to the flowcharts of FIGS. 6A and 6B, the operation of the air intake side secondary air supply system which performs the control method according to the present invention will be explained hereinafter.

Figure 6A:
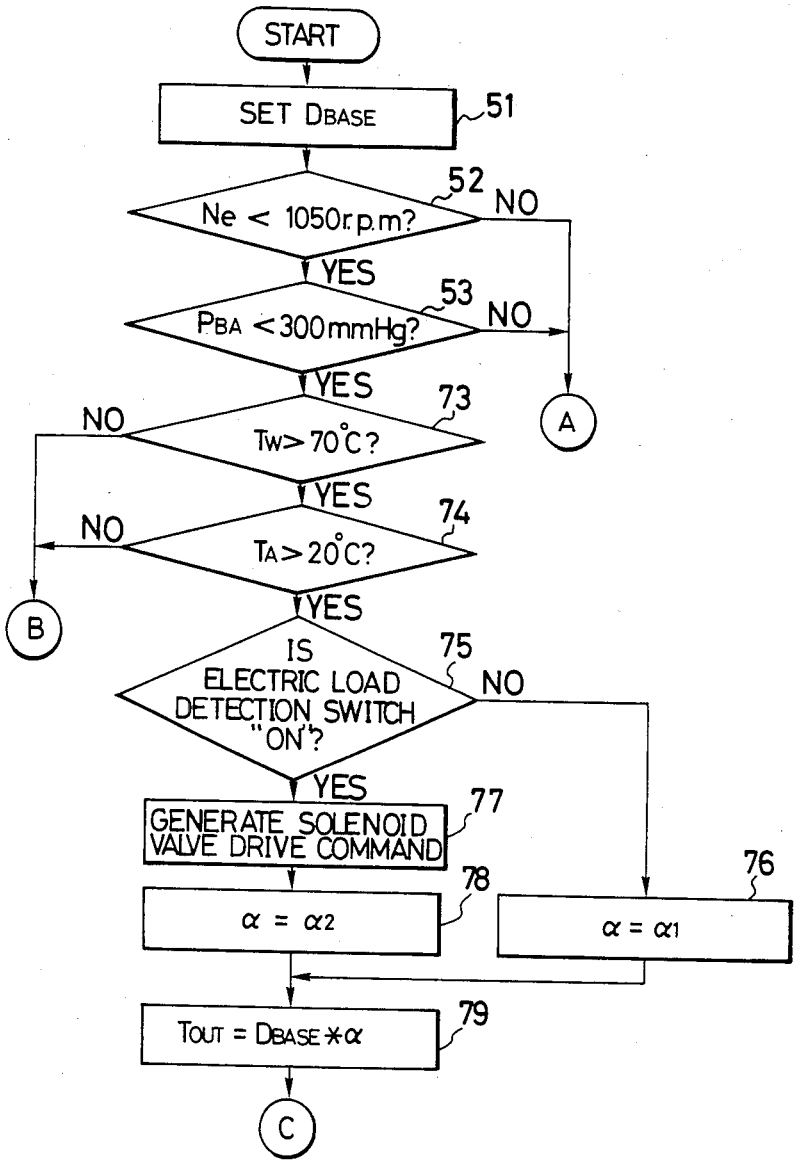
FIGS. 6A, and 6B, are flowcharts showing the manner of operation of a CPU 29 in the control circuit 20 according to the control method of the present invention.
Figure 6B:
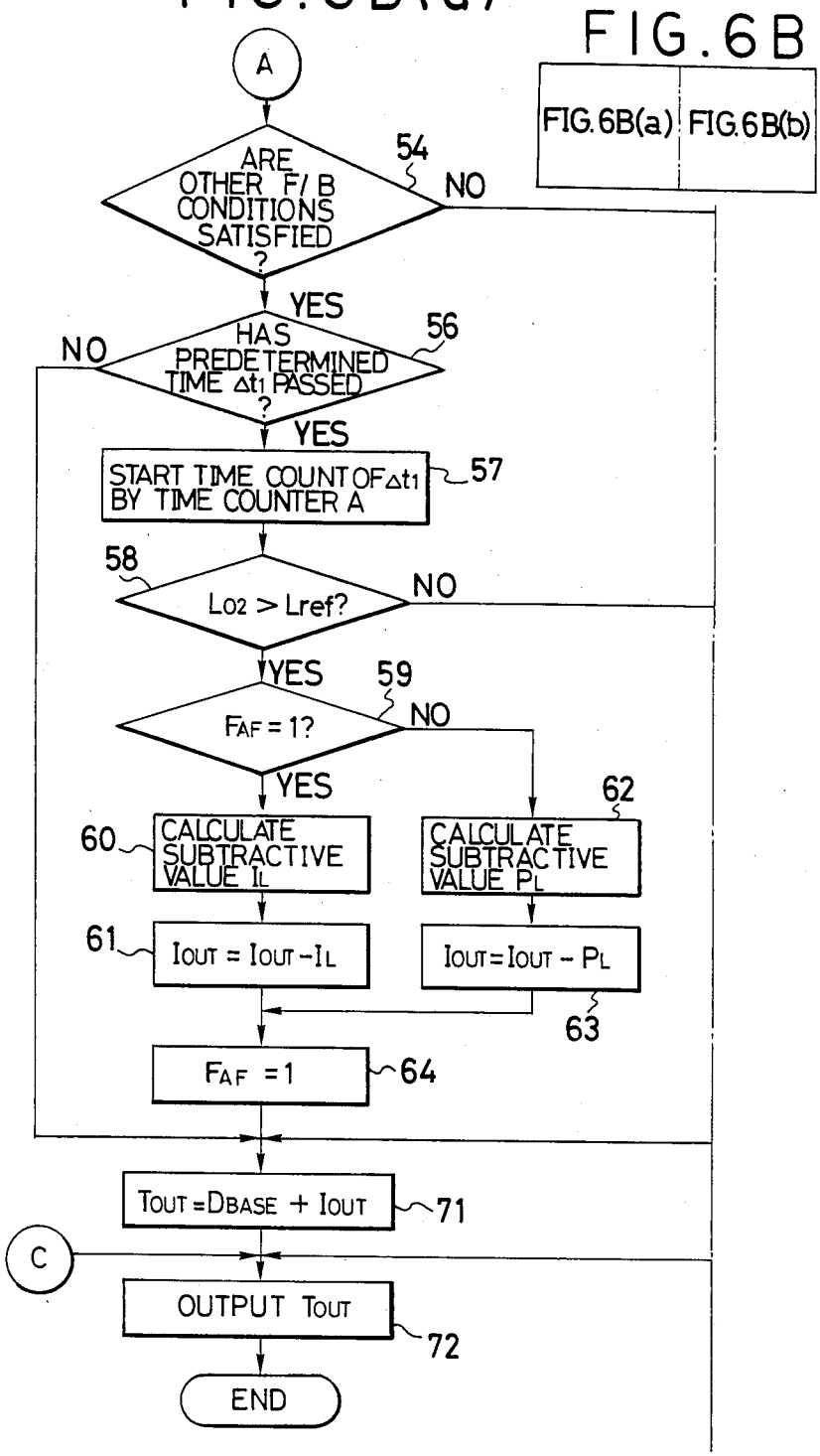
Figure 6B:
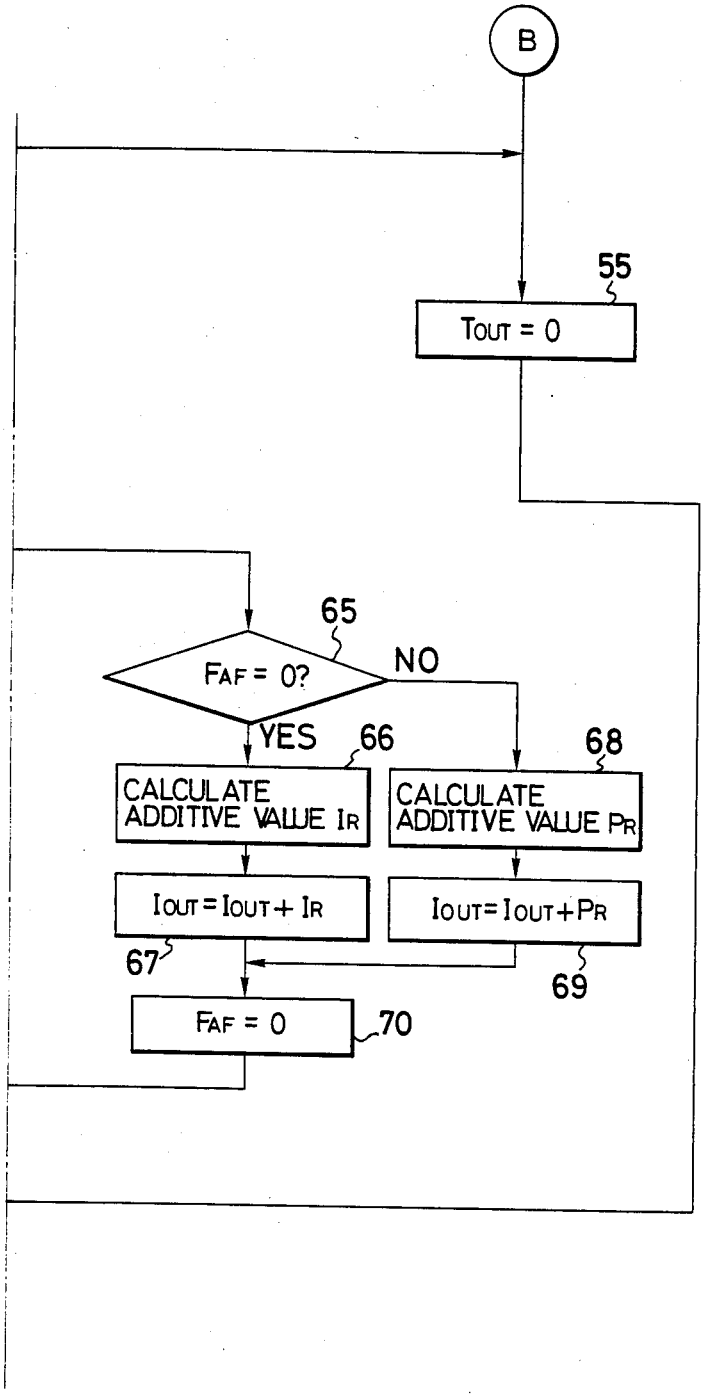
Figure 7:
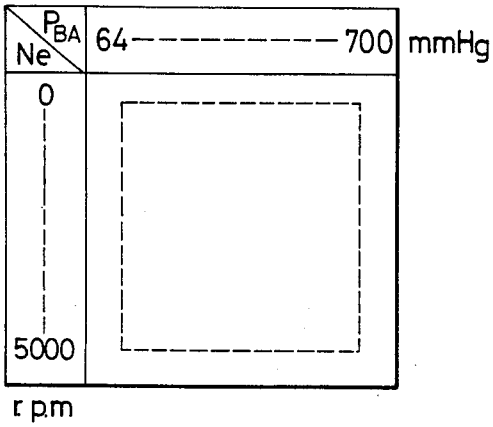
FIG. 7 is a diagram showing a $D_{BASE}$ data map which is previously stored in a ROM 30 of the control circuit 20.

As shown in FIG. 6A, in the CPU 29, a base value $D_{BASE}$ indicative of the base value of the current to the solenoid valve 9 is set at every time of the generation of the internal interruption signal, at a step 51. Various values of the base value $D_{BASE}$ which are determined according to an absolute pressure within the intake manifold $P_{BA}$ and the engine rotational speed $N_e$ are previously stored in the ROM 30 in the form of a $D_{BASE}$ data map as shown in FIG. 7, and the CPU 29 at first reads present values of the absolute pressure $P_{BA}$ and the engine rotational speed $N_e$ and in turn searches a value of the base value $D_{BASE}$ corresponding to the read values from the $D_{BASE}$ date map in the ROM 30. After the set of the base value $D_{BASE}$, whether or not the engine rotational speed $N_e$ is lower than 1050 rpm and whether or not the absolute pressure $P_{BA}$ in the intake manifold is smaller than 300 mmHg are respectively detected at steps 52 and 53 in order to detect the idling operation of the engine 5. If $N_e \geqq 1050$ rpm, or $P_{BA} \geqq 300$ mmHg, it is determined that the engine 5 is not idling, and whether or not the operating state of the vehicle (including the operating state of the engine) satisfies other conditions for the feedback (F/B) control is detected at a step 54. This detection is performed on the basis of the absolute pressure $P_{BA}$ within the intake manifold, the engine cooling water temperature $T_W$, and the engine rotational speed $N_e$. For instance, when the cooling water temperature is low, it is determined that the condition for the feedback control is not satisfied. If it is determined that the condition for the feedback control is not satisfied, the output value $T_{OUT}$ is made equal to "0" at a step 55 so that the feedback control is stopped.

On the other hand, if it is determined that the condition for the feedback control is satisfied, whether or not a count period of a time counter A incorporated in the CPU 29 (not shown) has reached a predetermined time period $\Delta t_1$ is detected at a step 56. This predetermined time period $\Delta t_1$ corresponds to a delay time from a time of the supply of the air intake side secondary air to a time in which a result of the supply of the air intake side secondary air is detected by the oxygen concentration sensor 14 as a change in the oxygen concentration of the exhaust gas. When the predetermined time period $\Delta t_1$ has lapsed after the time counter A is reset to start the counting of time, the counter is reset again, at a step 57, to start the counting of time from a predetermined initial value. In other words, a detection as to whether or not the predetermined time period $\Delta t_1$ has lapsed after the start of the counting of time from the initial value by the time counter A, i.e. the execution of the step 57, is performed at the step 56. After the start of the counting of the predetermined time period $\Delta t_1$ by the time counter A in this way, whether or not the output signal level $LO_2$ of the oxygen concentration sensor 14 is greater than a reference value Lref which corresponds to a target air/fuel ratio is detected at a step 58. In other words, whether or not the air/fuel ratio of mixture is leaner that the target air/fuel ratio is detected at the step 58. If $LO_2 > Lref$, it means that the air/fuel ratio of the mixture is leaner than the target air/fuel ratio, whether or not an air/fuel ratio flag $F_{AF}$ which indicates a result of a previous cycle of detection by the step 58 is equal to "1" is detected at a step 59. If $F_{AF}=1$, it means that the air/fuel ratio was detected to be lean in a previous detection cycle. Then, a subtractive value $I_L$ is calculated at a step 60. The subtractive value $I_L$ is obtained by multiplication of a constant $K_1$, the engine rotational speed $N_e$, and the absolute pressure $P_{BA}$, ($K_1 \cdot N_e \cdot P_{BA}$), and is dependent on the amount of the intake air of the engine 5. After the calculation of the subtractive value $I_L$, a correction value $I_{OUT}$ which is previously calculated by the execution of operations of the A/F routine is read out from a memory location $a_1$ in the RAM 31. Subsequently, the subtractive value $I_L$ is subtracted from the correction value $I_{OUT}$, and a result is in turn written in the memory location $a_1$ of the RAM 31 as a new correction value $I_{OUT}$, at a step 61. On the other hand, if $F_{AF}=0$, it means that the air/fuel ratio was detected to be rich in the previous detection cycle and the air/fuel ratio has changed from rich to lean. Therefore, a subtractive value $P_L$ is calculated at a step 62. The subtractive value $P_L$ is obtained by a multiplication between the subtractive value $I_L$ and a constant $K_3 (K_3 > 1)$. After the calculation of the subtractive value $P_L$ ($K_3 \cdot I_L$), the correction value $I_{OUT}$ which is previously calculated by the execution of operations of the A/F routine is read out from the memory location $a_1$ in the RAM 31. Subsequently, the subtractive value $P_L$ is subtracted from the correction value $I_{OUT}$, and a result is in turn written in the memory location $a_1$ of the RAM 31 as a new correction value $I_{OUT}$, at a step 63. After the calculation of the correction value $I_{OUT}$ at the step 61 or the step 63, a value "1" is set for the flag $F_{AF}$, at a step 64, for indicating that the air/fuel ratio is lean. On the other hand, if $LO_2 \leqq Lref$ at the step 58, it means that the air/fuel ratio is richer than the target air/fuel ratio. Then, whether or not the air/fuel ratio flag $F_{AF}$ is "0" is detected at a step 65. If $F_{AF}=0$, it means that the air/fuel ratio was detected to be rich in the previous detection cycle. Then, an additive value $I_R$ is calculated at a step 66. The additive value $I_R$ is calculated by a multiplication of a constant value $K_2$ ($\neq K_1$), the engine rotational speed $N_e$, and the absolute pressure $P_{BA}$ ($K_2 \cdot N_e \cdot P_{BA}$), and is dependent on the amount of the intake air of the engine 5. After the calculation of the additive value $I_R$, the correction value $I_{OUT}$ which is previously calculated by the execution of the A/F routine is read out from the memory location $a_1$ of the RAM 31, and the additive value $I_R$ is added to the read out correction value $I_{OUT}$. A result of the summation is in turn stored in the memory location $a_1$ of the RAM 31 as a new correction value $I_{OUT}$ at a step 67. If $F_{AF}=1$ at the step 65, it means that the air/fuel ratio was detected to be lean in the previous detection cycle, and the air/fuel ratio has changed from lean to rich. Therefore, a additive value $P_R$ is calculated at a step 68. The additive value $P_R$ is obtained by a multiplication between the additive value $I_R$ and a constant $K_4$ ($K_4 > 1$). After the calculation of the additive value $P_R$($K_4 \cdot I_R$), the correction value $I_{OUT}$ which is previously calculated by the execution of operations of the A/F routine is read out from the memory location $a_1$ in the RAM 31. Subsequently, the additive value $P_R$ is added to the correction value $I_{OUT}$, and a result is in turn written in the memory location $a_1$ of the RAM 31 as a new correction value $I_{OUT}$, at a step 69. After the calculation of the correction value $I_{OUT}$ at the step 67 or the step 69, a value "0" is set for the flag $F_{AF}$, at step 70, for indicating that the air/fuel ratio is rich. After the calculation of the correction value $I_{OUT}$ at the step 61, 63, 67 or 69 in this way, the correction value $I_{OUT}$ and the base value $D_{BASE}$ set at the step 51 are added together, and a result of addition is made as the output value $T_{OUT}$ at a step 71. After the calculation of the output value $T_{OUT}$, the output value $T_{OUT}$ is output to the drive circuit 28a at a step 72.

Additionally, after the reset of the time counter A and the start of the counting from the initial value at the step 57, if it is detected that the predetermined time period $\Delta t_1$ has not yet passed, at the step 56, the operation of the step 71 is immediately executed. In this case, the correction value $I_{OUT}$ calculated by the A/F routine up to the previous cycle is read out.

If $N_e < 1050$ rpm and $P_{BA} < 300$ mmHg at steps 52 and 53, it means that the engine is operating under the idling condition. Then, whether or not the cooling water temperature $T_W$ is higher than 70° C. and whether or not the temperature of the intake air $T_A$ is higher than 20° C. are detected at steps 73 and 74. If $T_W \leqq 70°$ C. or $T_A \leqq 20°$ C., it means that the temperature of the engine is low, and the output value $T_{OUT}$ is made equal to "0" at a step 55 in order to stop the control of the air/fuel ratio to the lean side. If $T_W > 70°$ C. and $T_A > 20°$ C., it means that the engine is idling when the engine temperature is not low. Therefore, from the on-off state of the electric load detection switch 19, whether or not the predetermined unit of large electric load is in operation is detected at a step 75. If the electric load detection switch 19 is in the off position, a lean control factor $\alpha$ is equalized to a predetermined value $\alpha_1$ at a step 76. Conversely, when the electric load detection switch 19 is in the on position, a solenoid value drive command is generated and supplied to the drive circuit **28*b* at a step 77, and the lean control factor $\alpha$ is equalized to a predetermined value $\alpha_2$ which is larger than the predetermined value $\alpha_1$ at a step 78. In response to the solenoid valve drive command, the drive circuit 28*b* drives the three-way solenoid valve 18 so that the vacuum in the intake manifold 4 is supplied to the pressure chamber 17*a*. As a result, the throttle valve 6 is opened by a predetermined opening degree. Then the lean control factor $\alpha$ is multiplied to the base value $D_{BASE}$ set at the step 51, and a value obtained by this calculation is derived as the output value $T_{OUT}$ at a step 79. Subsequently, by the execution of the operation of the step 72, the output value $T_{OUT}$ is supplied to the drive circuit 28*a***.

The drive circuit **28*a* is operative to detect the current flowing through the solenoid 9*a* of the solenoid valve 9 by means of the resistor for detecting the current, and to compare the detected magnitude of the current with the output value $T_{OUT}$. In response to a result of the comparison, the drive transistor is on-off controlled to supply the drive current of the solenoid 9*a*. In this way, the current flowing through the solenoid 9*a* becomes equal to a value represented by the output value $T_{OUT}$. Therefore, the air intake side secondary air whose amount is proportional to the magnitude of the current flowing through the solenoid 9*a* of the solenoid valve 9 is supplied into the intake manifold 4**.

Figure 3:
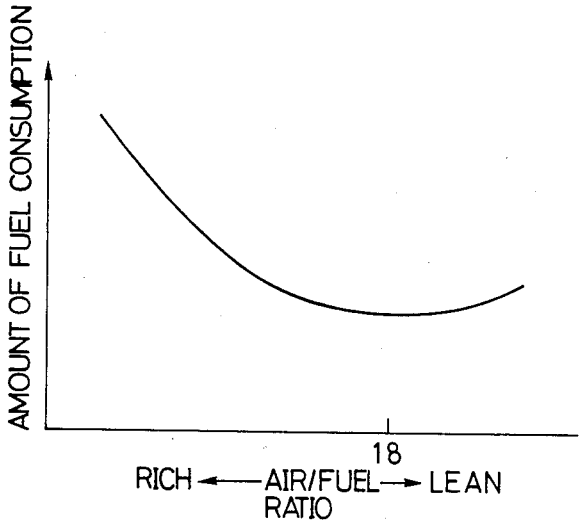
FIG. 3 is a diagram showing a characteristic curve which depicts a relation beteen the air/fuel ratio and the fuel consumption.

Thus, by the air/fuel ratio control method according to the present invention, the feedback control of the air/fuel ratio is stoped when the idle operation of the engine is detected. If the temperature of the engine is not low in such a state, the output value $T_{OUT}$ is determined by multiplying the lean control factor $\alpha$ to the base value $D_{BASE}$ so that the air/fuel ratio of the mixture is controlled to be leaner than the target air/fuel ratio for the feedback control of the air/fuel ratio. Further, if either of the head light and the air conditioner is in operation during the above described idling operation of the engine, the idle rotational speed control device is activated by the solenoid valve drive command so that the rotational speed of the engine is raised and the lean control factor is set at a larger value. The output value $T_{OUT}$ is enlarged in this way, to increase the amount of the secondary air. Thus the air/fuel ratio is further shifted to the lean side. It is to be noted that control of the air/fuel ratio to the lean side is performed within a range below an air/fuel ratio value of optimum fuel economy. This is because, as shown in FIG. 3, the fuel consumption of the engine increases when the air/fuel ratio is greater than 18, i.e., the air/fuel ratio of optimum fuel economy.

Above, the present invention has been described by way of the example in which the air/fuel ratio control is performed by adjusting the amount of the air intake side secondary air. However, it is to be noted that the present invention is applicable to the control of fuel injection time in an air/fuel ratio control system for an internal combustion engine of fuel injection type in which a fuel injector or injectors are utilized.

Figure 1:
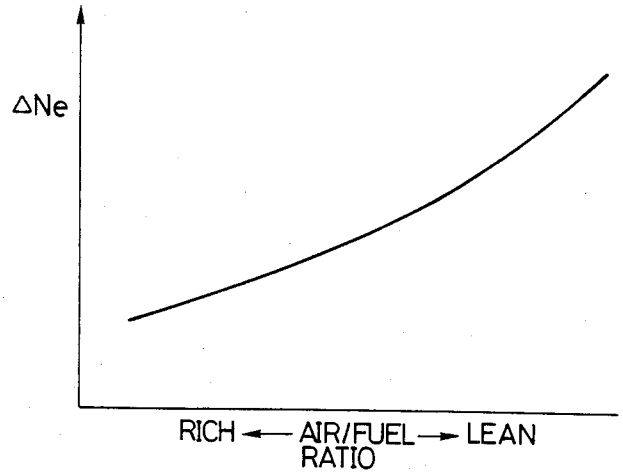
FIG. 1 is a diagram showing a characteristic curve which depicts a relation between the air/fuel ratio and the width of fluctuation of the engine rotation under a condition in which the weight of the intake air Gair is constant.
Figure 2:
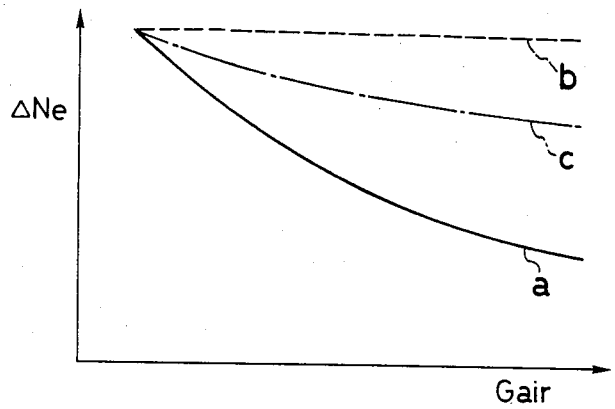
FIG. 2 is a diagram showing a characteristic curve which depicts a relation between the weight of the intake air Gair and the width of the fluctuation of the engine rotation under a condition in which the air/fuel ratio is constant.

As explained so far, in the method of controlling the air/fuel ratio according to the present invention, the air/fuel ratio of the mixture to be supplied to the engine is controlled to a further lean side when an operation of a unit (or an equipment) of larger electric load is detected. Therefore, as depicted by the dashed line b or the partly dotted line c of FIG. 2, the width $\Delta Ne$ of the fluctuation of the rotational speed of the engine with respect to the weight of the intake air Gair is maintained within a range in which an adverse effect on the stability of the idle speed of the engine is avoided although the width of the fluctuation becomes slightly larger than the level attained by the conventional system which is shown by the solid line a. Thus, the fuel economy is improved while the driveability of the vehicle is maintained.

What is claimed is:

1. A control method of controlling an air/fuel ratio of an internal combustion engine having a throttle valve and an idle rotational speed control device by which an opening degree of the throttle valve is increased when a unit of large electric load is operating while the engine is idling, the control method comprising steps of:

detecting an idling operation of said internal combustion engine;

controlling, when said idling operation is detected, an air/fuel ratio of mixture to be supplied to said internal combustion engine to a lean side with respect to a target air/fuel ratio which is to be used in a steady state operation of said internal combustion engine;

detecting an operation of said unit of large electric load during the idling operation of said internal combustion engine; and controlling the air/fuel ratio of mixture to be supplied to said internal combustion engine to a further lean side with respect to said target air/fuel ratio when said operation of said unit of large electric load is detected.

* * * * *